US008904790B2

(12) United States Patent
Jiang et al.

(10) Patent No.: US 8,904,790 B2
(45) Date of Patent: Dec. 9, 2014

(54) M-TYPE PULVERIZED COAL BOILER SUITABLE FOR ULTRAHIGH STEAM TEMPERATURE

(75) Inventors: Minhua Jiang, Beijing (CN); Ping Xiao, Beijing (CN); Jianzhong Jiang, Beijing (CN); Li Zhong, Beijing (CN)

(73) Assignee: Huaneng Clean Energy Research Institute, Beijing (CN)

( * ) Notice: Subject to any disclaimer, the term of this patent is extended or adjusted under 35 U.S.C. 154(b) by 0 days.

(21) Appl. No.: 13/579,173
(22) PCT Filed: Nov. 11, 2011

(86) PCT No.: PCT/CN2011/082086
§ 371 (c)(1),
(2), (4) Date: Aug. 15, 2012

(87) PCT Pub. No.: WO2012/119460
PCT Pub. Date: Sep. 13, 2012

(65) Prior Publication Data

US 2014/0033712 A1 Feb. 6, 2014

(30) Foreign Application Priority Data

Mar. 8, 2011 (CN) ..... 2011 1 0056111

(51) Int. Cl.

| | |
|---|---|
| ***F01K 7/34*** | (2006.01) |
| ***F22D 1/38*** | (2006.01) |
| ***F22B 29/06*** | (2006.01) |
| ***F22G 1/04*** | (2006.01) |
| ***F22G 7/12*** | (2006.01) |
| ***F22D 1/02*** | (2006.01) |
| ***F01K 13/00*** | (2006.01) |

(52) U.S. Cl.
CPC ... *F01K 7/34* (2013.01); *F22G 1/04* (2013.01); *F22G 7/12* (2013.01); *F22B 29/06* (2013.01); *F22D 1/02* (2013.01); *F01K 13/006* (2013.01)
USPC ..... 60/653; 60/679; 110/263; 122/406.4; 122/421; 122/466

(58) Field of Classification Search
CPC ..... F01K 13/006; F01K 7/22; F01K 7/34; F22B 29/06; F22D 1/02; F22G 1/04; F22G 7/12
USPC ..... 60/653, 670, 679; 122/1 A, 1 C, 406.4, 122/421, 477, 466; 110/263
See application file for complete search history.

(56) References Cited

U.S. PATENT DOCUMENTS

| | | | | |
|---|---|---|---|---|
| 2,830,440 | A * | 4/1958 | Durham | 60/653 |
| 4,442,797 | A * | 4/1984 | Strohmeyer, Jr. | 122/4 D |
| 4,592,293 | A * | 6/1986 | Toyama et al. | 110/347 |
| 5,943,865 | A | 8/1999 | Cohen | |
| 6,253,552 | B1 * | 7/2001 | Peletz, Jr. | 60/649 |
| 2010/0223926 | A1 * | 9/2010 | Orita et al. | 60/670 |

FOREIGN PATENT DOCUMENTS

| | | | |
|---|---|---|---|
| CN | 86100970 | A | 8/1986 |
| CN | 2151364 | Y | 12/1993 |
| CN | 201028469 | Y | 2/2008 |
| CN | 201050778 | Y | 4/2008 |
| CN | 101363615 | A | 2/2009 |
| CN | 201526948 | U | 7/2010 |
| CN | 101793388 | A | 8/2010 |
| CN | 102128443 | A | 7/2011 |
| CN | 201954519 | U | 8/2011 |
| EP | 0 192 044 | A1 | 8/1986 |

* cited by examiner

*Primary Examiner* — Hoang Nguyen
(74) *Attorney, Agent, or Firm* — Jenkins, Wilson, Taylor & Hunt, P.A.

(57) ABSTRACT

The disclosure provides an M-type pulverized coal boiler suitable for ultrahigh steam temperature. The pulverized coal boiler comprises a hearth of which the bottom is provided with a slag hole and a tail downward flue of which the lower part is provided with a flue gas outlet. The pulverized coal boiler further comprises a middle flue communicated between the hearth and the tail downward flue, wherein the middle flue comprises an upward flue and a hearth outlet downward flue of which the bottoms are mutually communicated and the upper ends are respectively communicated with the upper end of the hearth and the upper end of the tail downward flue to form a U-shaped circulation channel. In the pulverized coal boiler provided by the disclosure, the middle flue which extends downwards and can make flue gas flow along the U-shaped circulation channel is arranged between the outlet of the hearth and the tail downward flue, so that high-temperature flue gas from the hearth can be introduced into a position with low elevation through the downward flue, and final-stage convection heating surfaces (such as a high-temperature superheater and a high-temperature reheater) can be arranged at positions with low height, and the length of ultrahigh-temperature steam pipelines between the high-temperature superheater and a steam turbine, and between the high-temperature reheater and the steam turbine can be greatly reduced. Therefore, the manufacturing cost of a boiler unit is obviously reduced.

15 Claims, 10 Drawing Sheets

M-TYPE PULVERIZED COAL BOILER SUITABLE FOR ULTRAHIGH STEAM TEMPERATURE

CROSS-REFERENCE TO RELATED APPLICATIONS

This application is filed under the provisions of 35 U.S.C. §371 and claims the priority of International Patent Application No. PCT/CN2011/082086 filed on Nov. 11, 2011 and of Chinese Patent Application No. 201110056111.0 filed on Mar. 8, 2011. The disclosures of the foregoing international patent application and Chinese patent application are hereby incorporated by reference herein in their respective entireties.

TECHNICAL FIELD OF THE INVENTION

The disclosure relates to the field of combustion equipment, in particular to an M-type pulverized coal boiler suitable for ultrahigh steam temperature.

BACKGROUND OF THE INVENTION

Pulverized coal boiler generator set, as the core technology of thermal power generation, experiences one hundred years of development history. From the subcritical to the supercritical, then to the ultra-supercritical, China's coal-fired power technology gets a rapid development in recent years. The rapid development of ultra-supercritical coal-fired power technology and the improvement of unit efficiency are the most cost-effective way to realize energy saving and emission reduction and to reduce carbon dioxide emission.

At present, the generating efficiency of a subcritical single-reheat thermal power generating unit is about 37%, and the generating efficiency of a supercritical single-reheat thermal power generating unit is about 41%, and the generating efficiency of an ultra-supercritical single-reheat thermal power generating unit with the temperature of main steam and reheated stream of 600° C. is about 44%; if the steam parameter is further improved, the unit generating efficiency is expected to be further increased. For example, when the temperature of main steam and reheated stream reaches 700° C. or above, the generating efficiency of a single-reheat thermal power generating unit is expected to reach above 48.5%, and the generating efficiency of a double-reheat thermal power generating unit is expected to reach above 51%. Therefore, an advanced ultra-supercritical thermal power generating unit technology with steam temperature reaching or exceeding 700° C. is actively carried out in China, European Union, US and Japan.

The development of an advanced ultra-supercritical thermal power generating unit with ultrahigh steam parameters (the temperature of main steam and reheated steam reaches 700° C. or above) confronts with many important technical problems; in which, the major technical difficulty includes two aspects; one aspect is to develop a super alloy material meeting the application requirement of the advanced ultra-supercritical thermal power generating unit of ultrahigh steam temperature reached 700° C.; the other aspect is to realize the design optimization of the unit system and to reduce the manufacturing cost.

The research shows that the super alloy material most likely to be used for the high-temperature part of the ultra-supercritical thermal power generating unit mainly is a nickel base alloy. However, the nickel base alloy material is very expensive, more than 15 times of the price of a present common iron base heat resistant alloy steel of level 600° C.

According to the system deployment mode of a present common thermal power generating unit, if the nickel base alloy material is adopted, taking two 1000 MW ultra-supercritical units for example, just the cost of the four high-temperature pipelines between the main steam/reheated steam and a steam turbine would be increased to about 2.5 billion RMB from the present 300 million RMB. In addition, the manufacturing cost is increased when the high-temperature parts of the boiler and the steam turbine adopt a heat resistant alloy, finally the overall cost of the advanced ultra-supercritical unit of level 700° C. would be greatly higher than that of the thermal power generating unit of level 600° C., which limits the application and promotion of the advanced ultra-supercritical thermal power generating unit.

In addition, the common thermal power generating unit with the temperature of main steam and reheated steam of 600° C. or below can adopt a method of single-reheat or double-reheat steam. Although the double-reheat method can improve the unit efficiency to a great extent, the complexity of the unit system adopting the double-reheat technology is higher than that of the unit system adopting the single-reheat technology and the investment thereof is greatly increased, which limits the application of the double-reheat system. At present, most of the large-scale thermal power generating units adopts the single-reheat system, and few large-scale thermal power generating units adopt the double-reheat system. If the complexity and manufacturing cost of the double-reheat system can be reduced by optimizing the design of the unit system, the realistic feasibility of the large-scale thermal power generating unit adopting the double-reheat system would be greatly improved.

Therefore, the point on how to optimize the design of the unit system and reduce the consumption of a high-temperature material (for example, four pipelines) plays a great role in implementing the application and promotion of the ultra-supercritical unit of ultrahigh steam temperature, promoting the application of the double-reheat system to a large-scale thermal power generating unit and improving the generating efficiency of the unit.

A Chinese patent "A novel steam turbine generating unit" with patent number of 200720069418.3 discloses a method for reducing the length and cost of a high temperature and high pressure steam pipeline of a double-reheat unit by distributing a high shafting and a low shafting at different height; however, since the high shaft formed by a high pressure cylinder and a generating unit needs to be arranged at a height of about 80 meters, serious problems such as shaking might be caused, and it is needed to solve the technical problems of support and foundation, thus this arrangement method has not been applied.

At present, the pulverized coal boilers generally adopt an arrangement mode of π-type boiler or tower type boiler, and a few adopt a T-type boiler, in which, the π-type boiler is the most common boiler arrangement mode adopted by the large/middle-scale thermal power generating unit. As shown in FIG. 1, the boiler consists of a hearth and a tail flue, and part of heating surfaces is arranged in a horizontal flue and a shaft of the tail flue. When the boiler is arranged in a form of π, the height of the hearth is shorter than that of the tower type boiler; therefore, the π-type boiler is good for the areas with strong earthquake and strong wind, with low manufacturing cost. However, since the eddy and disturbance of the flue gas is severe, the flow uniformity of the flue gas is poor, and it is easy to cause uneven heating of the heating surfaces, thus great temperature deviation is caused; and the boiler is heavily abraded when inferior fuel is combusted.

In a tower type boiler, all heating surfaces are arranged above the hearth, and the tail downward vertical flue is not provided with a heating surface, as shown in FIG. 2. Compared with the π-type boiler, the area occupied by the tower type boiler is smaller, which is suitable for the project with factory lacking land. Since the flue gas of the tower type boiler flows upwards, the dust in the flue gas flows slower and slower or sinks under gravity, thus the abrasion of the heating surfaces is greatly reduced. Besides, since the flue gas has good flow uniformity, the temperature deviation of the heating surfaces and working medium is smaller. Further, the tower type boiler has a simple structure, and the inflation center and the seal design of the boiler are easy to process, and the arrangement is compact; therefore, for the ultra-supercritical unit, the tower type boiler has certain advantages.

As for the T-type boiler, the tail flue is divided into two convection shaft flues of the same size, wherein the two convection shaft flues are arranged at two sides of the hearth symmetrically, as shown in FIG. 3, so that the problem of difficult arrangement of the tail heating surface occurred in the π-type boiler can be avoided, the height of the outlet smokestack of the hearth can be reduced to reduce the thermal deviation of the flue gas along the height; besides, the flow rate of the flue gas in the shaft can be reduced to reduce abrasion. However, the area occupied by the T-type boiler is greater than that occupied by the π-type boiler, the gas-water pipeline connection system is complex and the metal consumption is big, thus the T-type boiler is less applied.

No matter what arrangement mode the boiler adopts, due to the need of heat transfer, the high-temperature heating surfaces need to be arranged at an area with high flue gas temperature, while the elevation of the position on which the area with high flue gas temperature is located is high (above 50 to 80 meters), thus the high-temperature steam connection pipeline between the high-temperature heating surface outlet and the steam turbine is very long (for example, for the tower type boiler, the length of a single high-temperature steam pipeline reaches 160 to 190 meters), and the cost is high, and the application of the double-reheat technology is limited. When the steam temperature reaches 700° C., since the material cost per unit weight of the high-temperature steam connection pipeline is greatly increased more than 10 times), the point on how to reduce the length of the high-temperature steam connection pipeline and reduce the usage amount of the high-temperature steam connection pipeline so as to reduce the manufacturing cost of the high-temperature boiler becomes a key technical problem to be solved.

Besides, it takes a relatively long time to burn out the pulverized coal in the hearth, thus a relatively high hearth height is needed; however, the increase of the hearth height means the great increase of the manufacturing cost. Thus, the point on how to prolong the burning time and improve the burnout degree of the pulverized coal particles in the case of not increasing the hearth height also becomes a long-term concerned technical problem in the technical field of boilers.

SUMMARY OF THE INVENTION

The main object of the disclosure is to provide a pulverized coal boiler suitable for ultrahigh steam temperature, in particular an M-type pulverized coal boiler suitable for ultrahigh steam temperature, so as to solve the technical problem of high manufacturing cost of a boiler caused by long high-temperature steam connection pipelines when the steam temperature of the supercritical unit or the ultra-supercritical unit reaches or even exceeds an ultrahigh steam temperature.

In order to achieve the object above, the disclosure provides a pulverized coal boiler suitable for ultrahigh steam temperature, in particular an M-type pulverized coal boiler suitable for ultrahigh steam temperature, comprising: a hearth, of which the bottom is provided with a slag hole; a tail downward flue, of which the lower part is provided with a flue gas outlet; wherein, the M-type pulverized coal boiler further comprise a middle flue communicated between the hearth and the tail downward flue, and the middle flue comprises: a hearth outlet downward flue and an upward flue of which the bottoms are mutually communicated and the upper ends are respectively communicated with the upper end of the hearth and the upper end of the tail downward flue to form a U-shaped circulation channel.

Further, the lower end of the middle flue has a distance of 10 to 30 meters from the ground.

Further, an arrangement mode of the middle flue is that the hearth outlet downward flue and the upward flue are arranged as two separate independent flues.

Further, another arrangement mode of the middle flue is that the middle flue comprises a vertical flue arranged between the hearth and the tail downward flue; the upper end of the vertical flue is respectively communicated with the upper end of the hearth and the upper end of the tail downward flue through a first horizontal flue and a second horizontal flue; a first partition wall is provided inside the vertical flue, the first partition wall extends downwards from the top to divide the vertical flue into the hearth outlet downward flue and the upward flue.

Further, multi-stage convection heating surfaces are arranged inside the middle flue; and the final-stage convection heating surfaces connected with a steam turbine in the multi-stage convection heating surfaces are arranged below other stages of convection heating surfaces.

Further, each convection heating surface of the final-stage convection heating surfaces is arranged at the lower part of the hearth outlet downward flue and/or the upward flue; each convection heating surface of the other stages of convection heating surfaces is arranged in the hearth outlet downward flue and/or the upward flue.

Further, the convection heating surfaces in the upward flue can be arranged in series, also can be arranged in parallel.

Further, convection heating surfaces in parallel arrangement are set in the upward flue; a second partition wall is arranged between the convection heating surfaces in parallel arrangement; and a flue gas baffle is arrange above the second partition wall.

Further, the convection heating surface comprises one or more of superheater, reheater and economizer.

Further, the outside of the middle flue is provided with a wall enclosure heating surface or a guard plate.

Further, both lower ends of the middle flue and the tail downward flue are provided with an ash hole.

Further, an air preheater is arranged inside the tail downward flue.

Further, a denitration system and/or a convection heating surface is further arranged inside the tail downward flue.

Further, the periphery of the hearth is provided with a water cooled wall; and a wall enclosure superheater is arranged at the part above the water cooled wall; the tops of the hearth, the middle flue and the tail downward flue are provided with a ceiling superheater; the upper part of the hearth is provided with a platen radiant heating surface.

The disclosure has advantages as follows:

1. By arranging a middle flue between the outlet of the hearth and the tail downward flue, the middle flue extends downwards and can make flue gas flow along a U-shaped circulation channel, high-temperature flue gas from the hearth can be introduced into a position with low elevation through the downward flue, and a high-temperature superheater and a high-temperature reheater can be arranged at positions with low height, and the length of ultrahigh-temperature steam pipelines between the high-temperature superheater/high-temperature reheater and a steam turbine can be greatly reduced. Therefore, the manufacturing cost of a boiler unit is obviously reduced. Meanwhile, the on-way resistance and the thermal loss of the pipelines are reduced and the unit efficiency is improved, thus the unit can adopt ultrahigh-temperature stream parameters (for example, steam temperature reaches 700° C.), and it is convenient for the unit adopting ultrahigh-temperature stream parameters and high steam temperature (for example, steam temperature reaches 600° C.) to adopt the double-reheat system.

2. Since convection heating surfaces are not arranged at the outlet of the hearth, high flue gas temperature can be maintained. Therefore, the pulverized coal not burnt out in the hearth can be further burned inside the downward flue communicated with the outlet of the hearth, with good burning-out performance and small thermal loss due to incomplete combustion.

3. With the sufficient development in the hearth and the downward flue, the flue gas rotationally flowing inside the hearth become more even and stable, enabling even heat absorption of heating surfaces, smaller temperature deviation of heating surfaces and working medium therein.

4. Since multi-stage convection heating surfaces are mainly arranged in the upward flue, the dust in the flue gas flows slower and slower or sinks under gravity, thereby reducing the abrasion of the heating surfaces.

5. The denitration system and the air preheater can be arranged in the tail downward flue systematically, thereby solving the problem of difficult arrangement of the denitration system in the π-type boiler due to space restriction.

Besides the object, features and advantages described above, the disclosure has other objects, features and advantages. The disclosure is further illustrated below in detail by reference to accompanying drawings.

BRIEF DESCRIPTION OF THE DRAWINGS

For a better understanding of the disclosure, accompanying drawings described hereinafter are provided to constitute one part of the application; the schematic embodiments of the disclosure and the description thereof are used to illustrate the disclosure but not to limit the disclosure improperly. In the accompanying drawings.

In the disclosure, the reference number in the accompanying drawings have implications as follows: 10—represents a hearth; 11—represents a slag hole; 12—represents a spirally-wound pipe type water cooled wall; 13—represents a platen radiant heating surface; 14—represents a single-rise threaded vertical pipe type water cooled wall; 20—represents a middle flue; 21—represents a hearth outlet downward flue; 22—represents a first horizontal flue; 23—represents an upward flue; 24—represents a second horizontal flue; 25—represents a first partition wall; 27—represents a middle ash hole; 30—represents a tail downward flue; 31—represents a tail ash hole; 33—represents a flue gas outlet; 35—represents a denitration system; 37—represents an air preheater; 41—represents a high-temperature superheater; 42—represents a high-temperature reheater; 43—represents a high-temperature double reheater; 44—represents a lower-temperature superheater; 45—represents a lower-temperature reheater; 46—represents a lower-temperature double reheater; 47—represents an economizer; 48—represents a second partition wall; 49—represents a flue gas baffle; 60—represents a steam turbine; 70—represents an ultrahigh-temperature steam pipeline.

DETAILED DESCRIPTION OF THE INVENTION

The embodiment of the disclosure is illustrated below in detail in conjunction with accompanying drawings, but the disclosure can be implemented by multiple modes limited and covered by claims.

Figure 1:
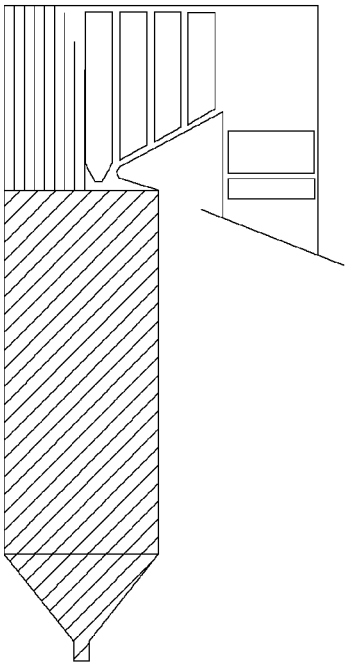
FIG. 1 shows a structure diagram of a π-type boiler according to relevant art.
Figure 2:
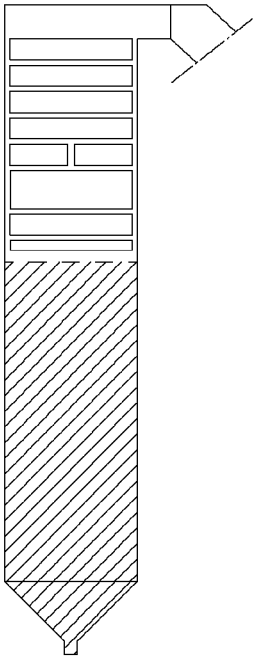
FIG. 2 shows a structure diagram of a tower type boiler according to relevant art.
Figure 3:
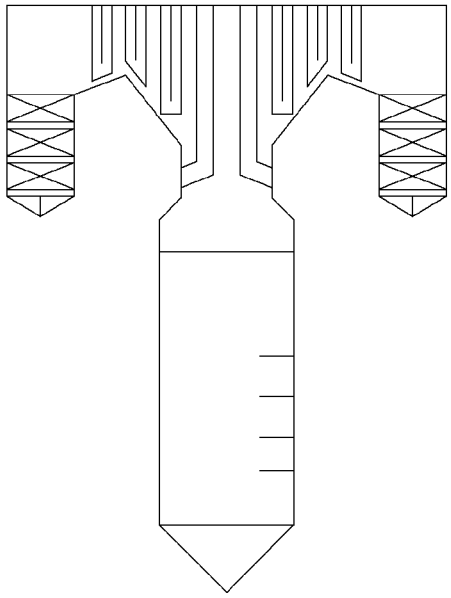
FIG. 3 shows a structure diagram of a T-type boiler according to relevant art.
Figure 4:
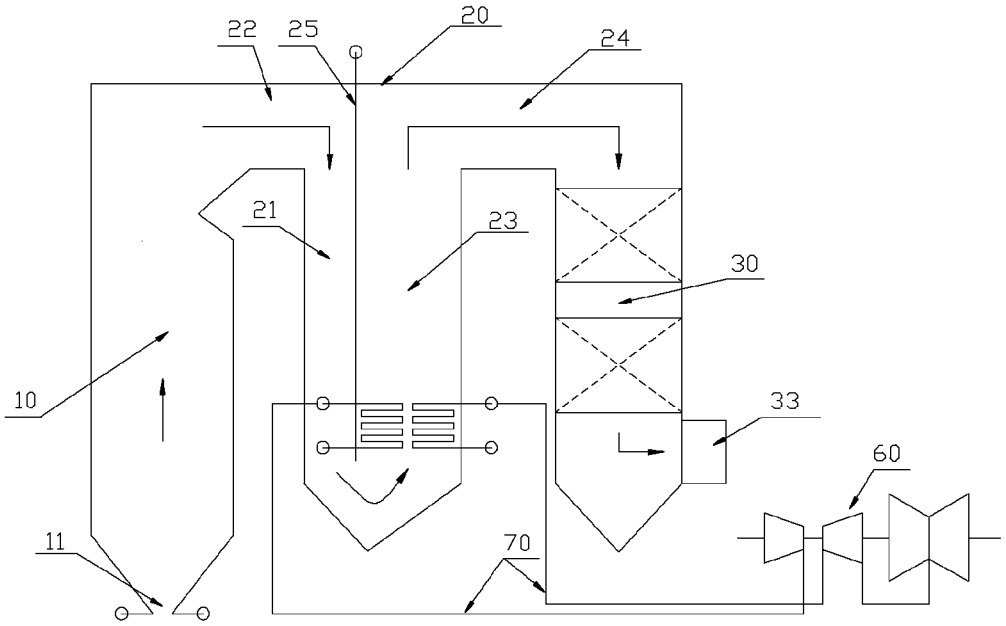
FIG. 4 shows a structure of a pulverized coal boiler in which a hearth outlet downward flue and an upward flue are formed by separating an integrated flue according to a preferred embodiment of the disclosure.

The disclosure provides a pulverized coal boiler suitable for ultrahigh steam temperature, in particular an M-type pulverized coal boiler suitable for ultrahigh steam temperature. FIG. 4 shows a structure of a pulverized coal boiler in which a hearth outlet downward flue and an upward flue are formed by separating an integrated flue. As shown in FIG. 4, the M-type pulverized coal boiler suitable for ultrahigh steam temperature provided by the disclosure comprises a hearth 10 and a tail downward flue 30 of which the upper end is communicated with the upper end of the hearth 10; the pulverized coal boiler further comprises a middle flue 20 communicated between the hearth 10 and the tail downward flue 30, wherein the middle flue 20 comprises: a hearth outlet downward flue 21 and an upward flue 23 of which the bottoms are mutually communicated and the upper ends are respectively communicated with the upper end of the hearth 10 and the upper end of the tail downward flue 30 to form a U-shaped circulation channel; the lower end of the hearth 10 is provided with a slag hole 11. From the whole shape of the pulverized coal boiler, the hearth 10, the middle flue 20 and the tail downward flue 30 form a shape similar to M; therefore, this type of pulverized coal boiler is called an M-type pulverized coal boiler.

With the U-shaped circulation channel, high-temperature flue gas from the outlet at the upper end of the hearth 10 can be introduced into a position with low elevation through the hearth outlet downward flue, so that a high-temperature superheater and a high-temperature reheater can be arranged at positions with low height, and the length of ultrahigh-temperature steam pipelines between the high-temperature superheater/high-temperature reheater and a steam turbine can be greatly reduced; therefore, the manufacturing cost of a boiler unit is obviously reduced; meanwhile, the on-way resistance and the thermal loss of the pipelines are reduced and the unit efficiency is improved, thus the unit can adopt ultrahigh-temperature stream parameters (for example, steam temperature reaches 700° C.), and it is convenient for the unit adopting ultrahigh-temperature stream parameters and high steam temperature (for example, steam temperature reaches 600° C.) to adopt the double-reheat system.

In order to achieve the object of introducing the high-temperature flue gas into a position with low elevation through the hearth outlet downward flue, the lower end of the middle flue 20 can be extended to a position having a distance of about 10 to 30 meters from the ground, that is, the lower end of the U-shaped circulation channel has a distance of about 10 to 30 meters from the ground; in this way, the flue gas can be introduced to a position with a height of about 10 to 30 meters. As a preferred embodiment, the lower end of the middle flue 20 can be extended to a position having a distance of about 20 to 30 meters from the ground, then the flue gas is introduced to a position having a distance of about 20 to 30 meters from the ground, and the final-stage convection heating surface used for heat exchange with the high-temperature flue gas can be arranged at the position having a distance of about 20 to 30 meters from the ground. Compared with the conventional art that the high-temperature flue gas is generally located at a position having elevation of above 60 to 70 meters, sometimes even of 80 to 90 meters, the disclosure obviously reduces the height of the high-temperature flue gas, thereby reducing the mounting height of the final-stage convection heating surface and reducing the length of the ultrahigh-temperature steam pipeline 70.

The middle flue 20 can comprise a vertical flue located between the hearth 10 and the tail downward flue 30, wherein the upper end of the vertical flue can be respectively communicated with the upper end of the hearth 10 and the upper end of the tail downward flue 30 through a first horizontal flue 22 and a second horizontal flue 24; inside the vertical flue is provided with a first partition wall 25 which extends downwards from the top to divide the vertical flue into a hearth outlet downward flue 21 and a upward flue 23, that is to say, the hearth outlet downward flue 21 and the upward flue 23 can be formed by dividing an independent vertical flue. The first horizontal flue 22 and the second horizontal flue 24 on two sides and the vertical flue can be an integrated flue, also can be a combined communicated flue. In this structure, the downward extending end of the vertical flue is the lower end of the middle flue 20, that is, the extending end of the vertical flue has a distance of about 20 to 30 meters from the ground. The temperature difference on two sides of the first partition wall 25 is great, which is not good for the arrangement of heating surfaces, but the partition wall occupies a smaller area.

Figure 5:
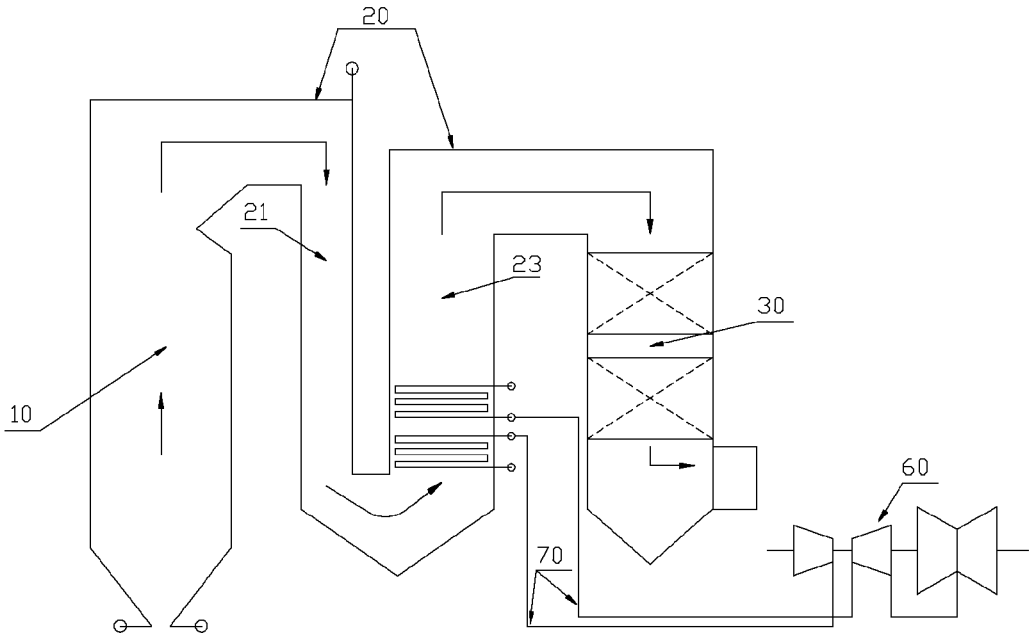
FIG. 5 shows a structure of a pulverized coal boiler in which a hearth outlet downward flue and an upward flue are separate independent flues according to another preferred embodiment of the disclosure.

Besides, the hearth outlet downward flue 21 and the upward flue 23 also can be two separate independent flues. FIG. 5 shows a structure of a pulverized coal boiler in which a hearth outlet downward flue and an upward flue are separate independent flues according to another preferred embodiment of the disclosure; as shown in FIG. 5, the upper end of the hearth outlet downward flue 21 is communicated with the upper end of the hearth 10 while the lower end of the hearth outlet downward flue 21 extends downwards to be communicated with the lower end of the upward flue 23, and the upper end of the upward flue 23 is communicated with the upper end of the tail downward flue 30, to finally form a U-shaped circulation channel. In this structure, the hearth outlet downward flue 21 and the upward flue 23 respectively serve as the left flue channel and the right flue channel of the U-shaped circulation channel to form the middle flue 20; the lower end of the middle flue 20 equals the lower end of the U-shaped circulation channel formed by communicating the hearth outlet downward flue 21 and the upward flue 23, that is to say, the lowest end of the U-shaped circulation channel has a distance of about 20 to 30 meters from the ground.

The connection flue between the upper end of the upward flue 23 and the upper end of the tail downward flue 30 can be lower in height than the connection flue between the upper end of the hearth outlet downward flue 21 and the upper end of the hearth 10, so as to reduce the circulation distance of the low-temperature flue gas before entering the tail downward flue 30 and reduce the loss of thermal loss. With this separate structure, the first partition wall 25 (refer to FIG. 4) is not needed, and the problem of great temperature difference on two sides of the partition wall 25 (refer to FIG. 4) is avoided, but the area occupied is increased.

No matter what are the forming mode of the hearth outlet downward flue 21 and the upward flue 23, the cross section area of the hearth outlet downward flue 21 can designed to be equal to or less than the cross section area of the upward flue 23. As a preferred embodiment, the cross section area of the hearth outlet downward flue 21 can designed to be less than the cross section area of the upward flue 23. In this way, the flow rate of the flue gas inside the hearth outlet downward flue 21 is accelerated. Besides, for the hearth outlet downward flue 21 and the upward flue 23 of separate structures, the design that the cross section area of the hearth outlet downward flue 21 is less than the cross section area of the upward flue 23 also can achieve an effect of reducing the overall area occupied by the middle flue 20.

Figure 6:
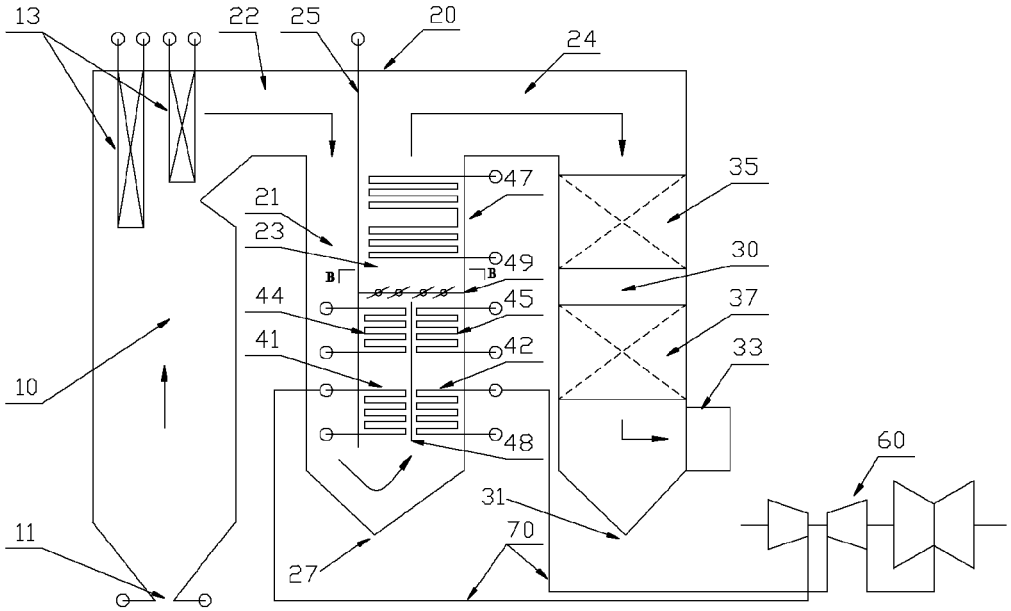
FIG. 6 shows a structure of a pulverized coal boiler in which each heating surface adopts a first arrangement mode in the middle flue shown in FIG. 4.

As shown in FIG. 6, multi-stage convection heating surfaces can be arranged inside the middle flue 20, wherein the arrangement order of the convection heating surfaces can be based on the temperature of the working medium inside the convection heating surfaces; in order to reduce the length of the ultrahigh-temperature steam pipeline 70, the high-temperature convection heating surface connected to a steam turbine 60, that is, the final-stage convection heating surface, is arranged at a lower position inside the middle flue 20, that is to say, the final-stage convection heating surface connected to the steam turbine 60 is arranged below the other stages of convection heating surfaces.

Specifically, the final-stage convection heating surface is arranged at the bottom of the hearth outlet downward flue 21 and/or the upward flue 23, and no convection heating surface is arranged at the upper part of the hearth outlet downward flue 21 or in the entire route of the hearth outlet downward flue 21, so that the flue gas is fully developed in the hearth outlet downward flue 21, thereby enabling a more even and stable flue gas flow and reducing the temperature deviation of the convection heating surface and the working medium therein.

Different convection heating surfaces are arranged in series or in parallel. When the convection heating surfaces are arranged in parallel, a second partition wall 48 is further arranged between the convection heating surfaces arranged in parallel and a flue gas baffle 49 is arranged above the second partition wall 48.

In order to reduce the abrasion of each convection heating surface caused by dust in the flue gas, except the final-stage convection heating surface, other stages of convection heating surfaces are arranged inside the upward flue 23. In this way, during the rising process of the flue gas inside the upward flue 23, the dust in the flue gas sinks or flows slower and slower under gravity, thereby achieving an effect of protecting heating surfaces.

The convection heating surface above mainly comprises one or more of superheater, reheater and economizer, wherein each type of convection heating surface can be optionally arranged inside the hearth outlet downward flue 21 and/or the upward flue 23 and/or the tail downward flue 30 in series or in parallel.

Several common arrangement modes of convection heating surfaces are introduced below in conjunction with accompanying drawings.

Referring to FIG. 6 again, no pipe type heating surface is arranged in the hearth outlet downward flue 21, and a high-temperature superheater 41 and a high-temperature reheater 42 are arranged at the lower part of the upward flue 23 in parallel, and a lower-temperature superheater 44 and a lower-temperature reheater 45 are arranged at the middle part of the upward flue 23 in parallel, and an economizer 47 is arranged at the upper part of the upward flue 23.

A second partition wall 48 parallel to a partition wall 25 is arranged between the high-temperature superheater 41 and the high-temperature reheater 42, and between the lower-temperature superheater 44 and the lower-temperature reheater 45. A flue gas baffle 49 used for adjusting the flue gas flow distribution is arranged above the second partition wall 48, that is, above the lower-temperature superheater 44 and the lower-temperature reheater 45. Outlet headers of the high-temperature superheater 41 and the high-temperature reheater 42 are respectively connected to inlets of a high-pressure cylinder and a middle-pressure cylinder of a steam turbine 60 through respective ultrahigh-temperature steam pipelines 70.

The main feature of this arrangement mode lies in that: the boiler adopts single-reheat system, no pipe type convection heating surface is arranged in the hearth outlet downward flue 21 of the hearth outlet, and the superheater and the reheater are arranged in parallel by arranging the second partition wall 48 in the upward flue 23, and the flue gas baffle 49 is arranged for adjusting the heat absorption proportion between each convection heating surface. At this moment, the width of the hearth outlet downward flue 21 communicated with the outlet of the hearth 10 can be designed narrower, to accelerate the flow rate of the flue gas inside the hearth outlet downward flue 21 while reducing the area occupied, and the arrangement of the second partition wall 48 in the upward flue 23 facilitates the temperature adjustment of flue gas.

Figure 7:
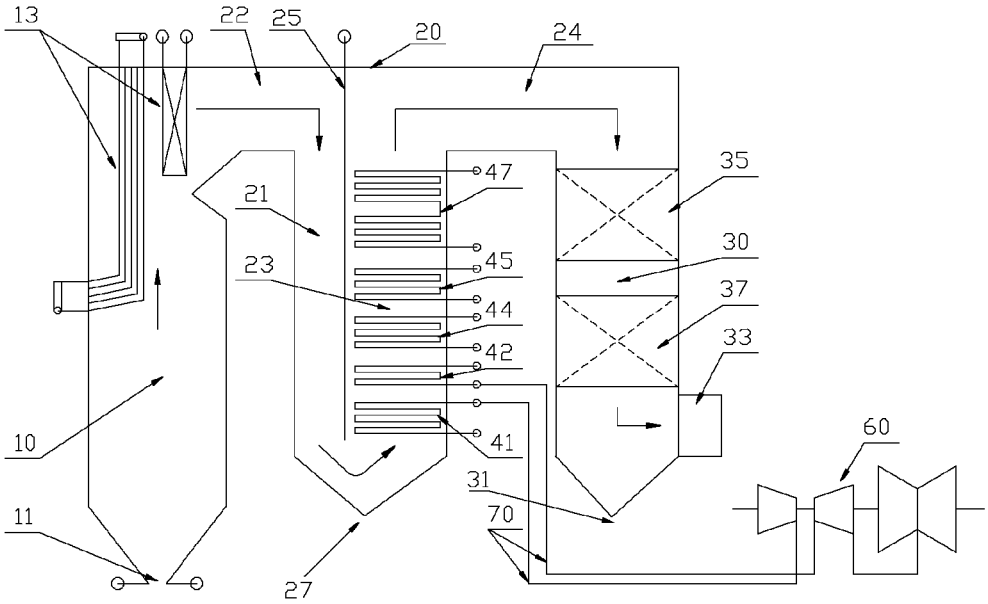
FIG. 7 shows a structure of a pulverized coal boiler in which each heating surface adopts a second arrangement mode in the middle flue shown in FIG. 4.

FIG. 7 shows a structure of a pulverized coal boiler in which each heating surface adopts a second arrangement mode in the middle flue shown in FIG. 4; as shown in FIG. 7, no pipe type convection heating surface is arranged in the hearth outlet downward flue 21; a high-temperature superheater 41, a high-temperature reheater 42, a lower-temperature superheater 44, a lower-temperature reheater 45 and an economizer 47 are arranged in the upward flue 23 in series from bottom to top. Outlet headers of the high-temperature superheater 41 and the high-temperature reheater 42 are respectively connected to inlets of a high-pressure cylinder and a middle-pressure cylinder of a steam turbine 60 through respective ultrahigh-temperature steam pipelines 70.

The main feature of this arrangement mode lies in that: the boiler adopts single-reheat system, no pipe type convection heating surface is arranged in the hearth outlet downward flue 21 of the hearth outlet; the high-temperature superheater 41, the high-temperature reheater 42, the lower-temperature superheater 44, the lower-temperature reheater 45 and the economizer 47 are arranged in the upward flue 23 in series. At this moment, the suspension and the arrangement of the heating surfaces are easy; the width of the hearth outlet downward flue 21 can be designed narrower. The high-temperature reheater 42 adopts counter cross layout to further reduce the length of the ultrahigh-temperature steam pipeline 70; part of a platen superheater 13 adopts wing type to reduce the length of the steam pipeline between an outlet header of the platen heating surface and an inlet header of the high-temperature heating surface.

Figure 8:
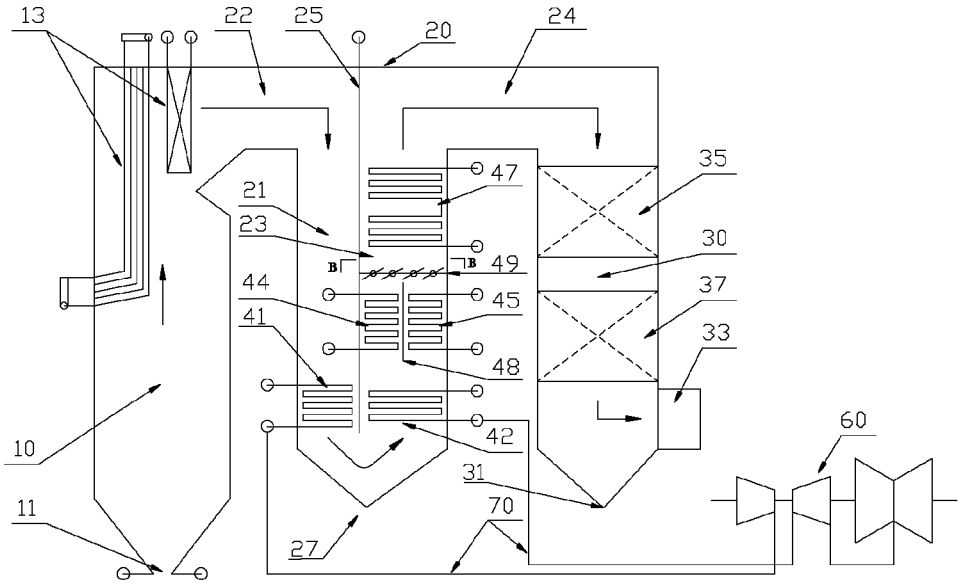
FIG. 8 shows a structure of a pulverized coal boiler in which each heating surface adopts a third arrangement mode in the middle flue shown in FIG. 4.

FIG. 8 shows a structure of a pulverized coal boiler in which each heating surface adopts a third arrangement mode in the middle flue shown in FIG. 4; as shown in FIG. 8, a high-temperature superheater 41 is arranged at the bottom of the hearth outlet downward flue 21; a high-temperature reheater 42 is arranged at the lower part of the upward flue 23; the high-temperature reheater 42 can adopt counter cross layout. A second partition wall 48 is arranged at the middle part of the upward flue 23, wherein two sides of the second partition wall 48 are provided with a lower-temperature superheater 44 and a lower-temperature reheater 45; a flue gas baffle 49 used for adjusting the flue gas flow distribution is arranged above the second partition wall 48; and an economizer 47 is arranged above the flue gas baffle 49. Outlet headers of the high-temperature superheater 41 and the high-temperature reheater 42 are respectively connected to inlets of a high-pressure cylinder and a middle-pressure cylinder of a steam turbine 60 through respective ultrahigh-temperature steam pipelines 70.

Figure 9:
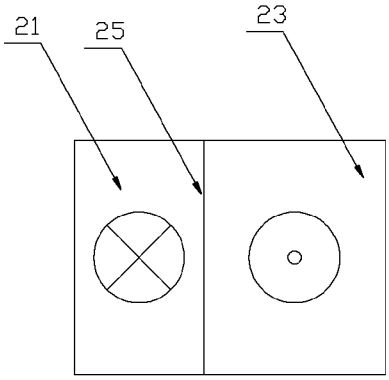
FIG. 9 shows a diagram of a first location relationship between a first partition wall and a second partition wall observed from the B-B direction in FIG. 6 and FIG. 8.
Figure 10:
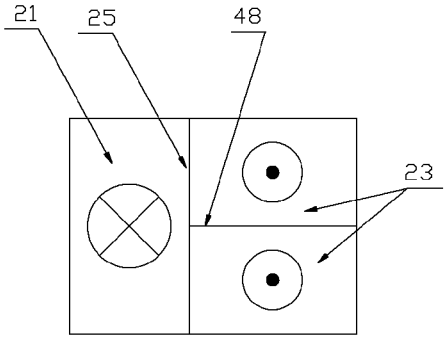
FIG. 10 shows a diagram of a second location relationship between a first partition wall and a second partition wall observed from the B-B direction in FIG. 6 and FIG. 8.
Figure 11:
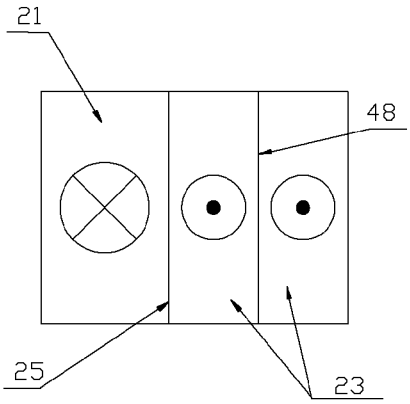
FIG. 11 shows a diagram of a third location relationship between a first partition wall and a second partition wall observed from the B-B direction in FIG. 6 and FIG. 8.

Actually, the second partition wall 48 can be parallel to the first partition wall 25, also can be perpendicular to the first partition wall 25. FIG. 9 to FIG. 11 respectively show diagrams of a first location relationship, a second location relationship and a third location relationship between a first partition wall 25 and a second partition wall 48 observed from the B-B direction in FIG. 6 and FIG. 8. As shown in FIG. 9, the second partition wall 48 might not be arranged in the upward flue 23 (refer to FIG. 8), with the first partition wall 25 arranged only. As shown in FIG. 10, the second partition wall 48 also can be perpendicular to the first partition wall 25. As shown in FIG. 11, the second partition wall 48 also can be parallel to the first partition wall 25.

The main feature of this arrangement mode lies in that: the boiler adopts single-reheat system; the high-temperature superheater 41 is arranged at the lower part of the hearth outlet downward flue 21; the second partition wall 48 and the flue gas baffle 49 are arranged in the upward flue 23. At this moment, the arrangement space of the convection heating surfaces is relatively abundant. The depth of the hearth outlet downward flue 21 and the upward flue 23 can be designed relatively shallow (that is, the length of the dimension not shown in the figure, the depth being shallow means the area occupied is small), but the suspension and the arrangement of the high-temperature superheater 41 are difficult.

Figure 12:
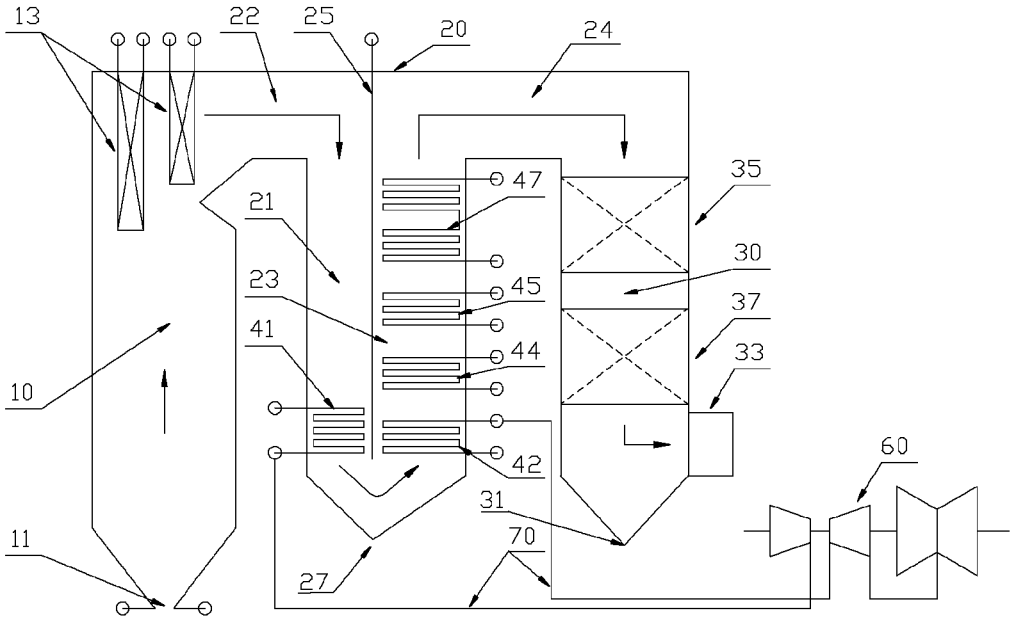
FIG. 12 shows a structure of a pulverized coal boiler in which each convection heating surface adopts a fourth arrangement mode in the middle flue shown in FIG. 4.

FIG. 12 shows a structure of a pulverized coal boiler in which each convection heating surface adopts a fourth arrangement mode the a middle flue shown in FIG. 4; as shown in FIG. 12, a high-temperature superheater 41 is arranged at the bottom of the hearth outlet downward flue 21; a high-temperature reheater 42, a lower-temperature superheater 44, a lower-temperature reheater 45 and an economizer 47 are arranged in the upward flue 23 in series from bottom to top.

The main feature of this arrangement mode lies in that: the boiler adopts single-reheat system; each superheater and each reheater are arranged along the flowing direction of the flue gas in turn; the high-temperature superheater 41 is arranged at the lower part of the hearth outlet downward flue 21. At this moment, the arrangement space of each convection heating surface is relatively abundant; the depth of the hearth outlet downward flue 21 and the upward flue 23 can be designed relatively shallow.

Figure 13:
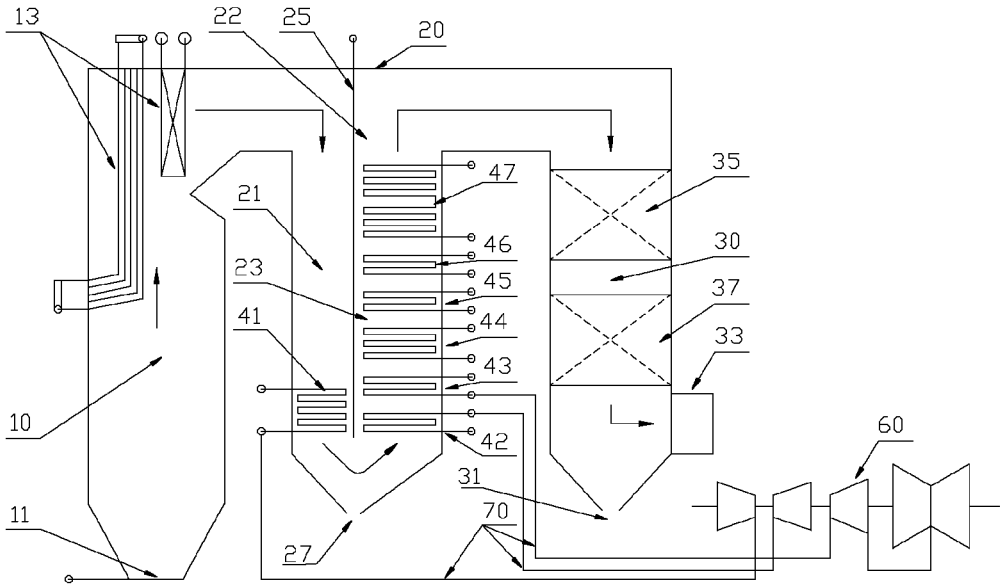
FIG. 13 shows a structure of a pulverized coal boiler in which each convection heating surface adopts a fifth arrangement mode in the middle flue shown in FIG. 4.

FIG. 13 shows a structure of a pulverized coal boiler in which each convection heating surface adopts a fifth arrangement mode in the middle flue shown in FIG. 4; as shown in FIG. 13, a high-temperature superheater 41 is arranged at the bottom of the hearth outlet downward flue 21; a high-temperature reheater 42, a high-temperature double reheater 43, a lower-temperature superheater 44, a lower-temperature reheater 45, a lower-temperature double reheater 46 and an economizer 47 are arranged in the upward flue 23 in series from bottom to top. Outlet headers of the high-temperature superheater 41, the high-temperature reheater 42 and the high-temperature double reheater 43 are respectively connected to inlets of a high-pressure cylinder, a first middle-pressure cylinder and a second middle-pressure cylinder of a steam turbine 60 through respective ultrahigh-temperature steam pipelines 70.

The main feature of this arrangement mode lies in that: the boiler adopts double-reheat system so as to obtain a higher generating efficiency of a thermal power generating unit.

Figure 14:
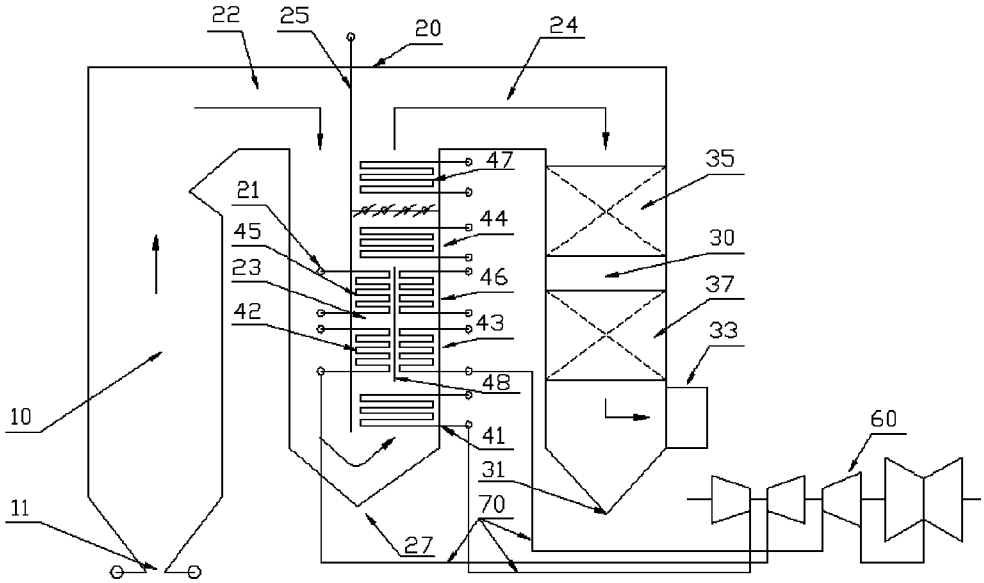
FIG. 14 shows a structure of a pulverized coal boiler in which each convection heating surface adopts a sixth arrangement mode in the middle flue shown in FIG. 4.

FIG. 14 shows a structure of a pulverized coal boiler in which each convection heating surface adopts a sixth arrangement mode in the middle flue shown in FIG. 4; as shown in FIG. 14, a high-temperature superheater 41 is arranged at the bottom of the upward flue 23; a second partition wall 48 is arranged in the upward flue 23; one side of the second partition wall 48 is provided with a high-temperature reheater 42 and a lower-temperature reheater 45, while the other side is provided with a high-temperature double reheater 43 and a lower-temperature double reheater 46; a flue gas baffle 49 used for adjusting flow gas distribution is arranged above the second partition wall 48, and a lower-temperature superheater 44 and an economizer 47 are arranged above the flue gas baffle 49. Outlet headers of the high-temperature superheater 41, the high-temperature reheater 42 and the high-temperature double reheater 43 are respectively connected to inlets of a high-pressure cylinder, a first middle-pressure cylinder and a second middle-pressure cylinder of a steam turbine 60 through respective ultrahigh-temperature steam pipelines 70.

The main feature of this arrangement mode lies in that: the boiler adopts double-reheat system so as to obtain a higher generating efficiency of a thermal power generating unit; there is no platen heating surface, and the heat absorption amount of the reheated heating surfaces can be adjusted through the flue gas baffle 49.

Figure 15:
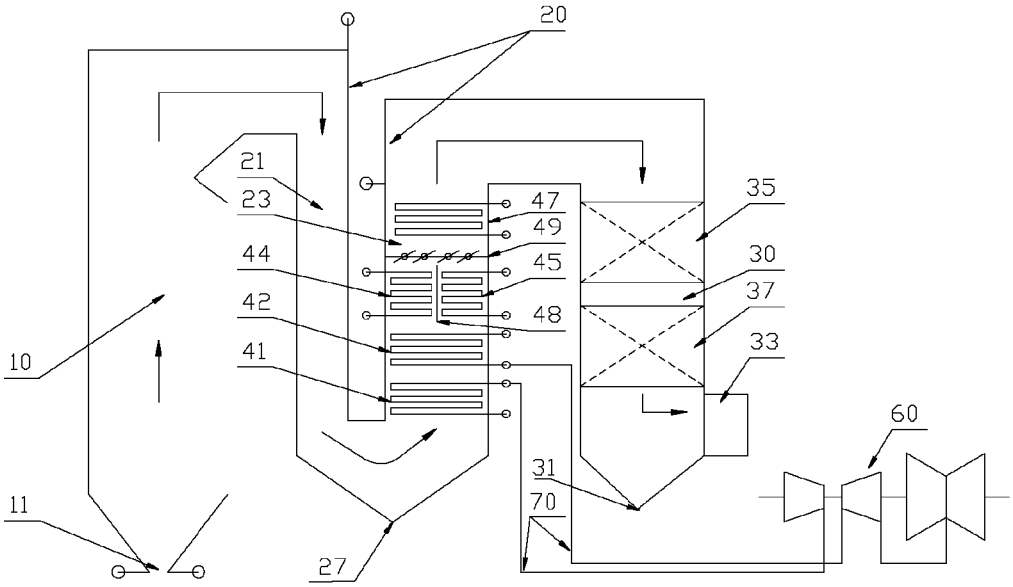
FIG. 15 shows a structure of a pulverized coal boiler in which each convection heating surface adopts a seventh arrangement mode in the middle flue shown in FIG. 5.

FIG. 15 shows a structure of a pulverized coal boiler in which each convection heating surface adopts a seventh arrangement mode in the middle flue shown in FIG. 5; as shown in FIG. 15, a high-temperature superheater 41 and a high-temperature reheater 42 are arranged at the bottom of the upward flue 23; an economizer 47 is arranged at the upper part of the upward flue 23; a second partition wall 48 is arranged at the middle part of the upward flue, wherein two sides of the second partition wall 48 are provided with a lower-temperature superheater 44 and a lower-temperature reheater 45, and a flue gas baffle 49 used for adjusting flow gas distribution is arranged above the second partition wall 48.

The main feature of this arrangement mode lies in that: the boiler adopts single-reheat system; no platen heating surface is arranged at the top of the hearth and no pipe type convection heating surface is arranged in the hearth outlet downward flue 21 at the hearth outlet; the superheater and the reheater are arranged in parallel by arranging the second partition wall 48 in the upward flue 23, and the flue gas baffle 49 is arranged for adjusting the heat absorption proportion between the heating surfaces. The hearth outlet downward flue 21 and the upward flue 23 are arranged separately and independently, without the problem of high temperature difference on two sides of the first partition wall 25. The arrangement of the second partition wall 48 facilitates the adjustment of gas temperature; the height of the upward flue 23 can be lower than that of the hearth outlet downward flue 21, but the area occupied is increased; the enclosure wall heating surface at the periphery of the hearth outlet downward flue 21 and the upward flue 23 is arranged more properly.

Figure 16:
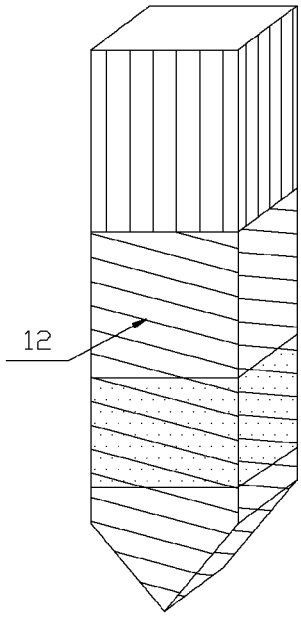
FIG. 16 shows a structure diagram of a spirally-wound pipe type water cooled wall.
Figure 17:
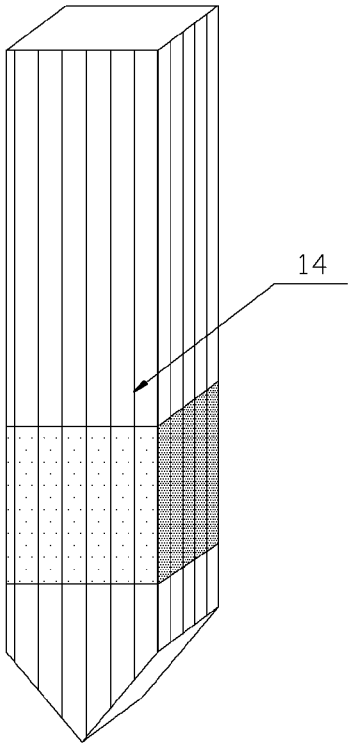
FIG. 17 shows a structure diagram of a single-rise threaded vertical pipe type water cooled wall.

In order to absorb the heat of the high-temperature flame or flue gas in the hearth 10 and to reduce the temperature of the hearth wall so as to achieve a better protection for the hearth wall, a water cooled wall can be arranged around the hearth 10, and an enclosure wall heating surface can be arranged above the water cooled wall as needed. FIG. 16 and FIG. 17 respectively show structure diagrams of a spirally-wound pipe type water cooled wall 12 and a single-rise threaded vertical pipe type water cooled wall 14. As shown in FIG. 16 and FIG. 17, the water cooled wall can be one or more of spirally-wound pipe type water cooled wall, threaded vertical pipe type water cooled wall and low-mass flow-rate threaded vertical pipe type water cooled wall.

Figure 18:
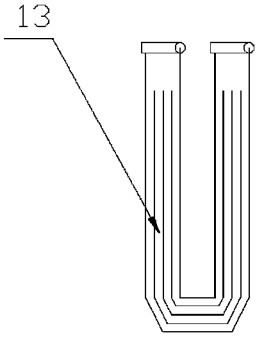
FIG. 18 shows a structure diagram of a suspending type platen radiant heating surface.
Figure 19:
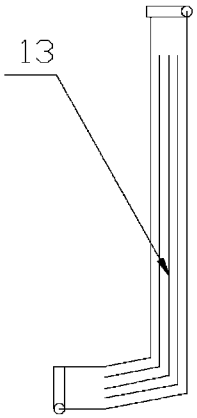
FIG. 19 shows a structure diagram of a wing type platen radiant heating surface.

Refer to FIG. 6, FIG. 7, FIG. 8. FIG. 12 and FIG. 13 again, a platen radiant heating surface 13 also can be arranged at the upper part of the hearth 10, wherein the platen radiant heating surface 13 can be a superheater, a reheater or an evaporating heating surface. FIG. 18 and FIG. 19 respectively show structure diagrams of a suspending type platen radiant heating surface and a wing type platen radiant heating surface. As shown in FIG. 18 and FIG. 19, the platen radiant heating surface 13 can be a suspending type platen radiant heating surface, also can be a wing type platen radiant heating surface, particularly, the selection of a wing type platen radiant heating surface can further reduce the length of a steam pipeline between an outlet header of the platen heating surface and an outlet header of the final-stage convection heating surface, to further reduce the cost of a boiler unit.

The periphery of the middle flue 20, that is, the periphery of the hearth outlet downward flue 21 and the upward flue 23, can be formed by an enclosure wall heating surface, also a guard plate can be arranged at the periphery of the hearth outlet downward flue 21 and the upward flue 23, wherein the guard plate is generally a metal guard plate.

Refer to FIG. 6, FIG. 7, FIG. 8. FIG. 12, FIG. 13, FIG. 14 and FIG. 15 again, a middle ash hole 27 and a tail ash hole 31 can be respectively arranged at the bottoms of the middle flue 20 and the tail downward flue 30, wherein the ash hole generally is arranged at the lowest end of the flue and is opened to discharge ash when needed.

The cooling medium inside the first partition wall 25, the enclosure wall heating surface and the second partition wall 48 can be water or steam.

A denitration system 35 and an air preheater 37 can be arranged in the tail downward flue 30, thereby effectively solving the problem of difficult arrangement of the denitration system in the π-type boiler due to space restriction. Besides, when there are too many convection heating surfaces to be arranged in the upward flue 23, part of the convection heating surfaces also can be arranged in the tail downward flue 30.

The flue gas outlet 33 arranged at the lower part of the tail downward flue 30 is generally arranged at a position below the denitration system 35 and the air preheater 37, so that the flue gas can flow through the denitration system 35 and the air preheater 37.

Figure 20:
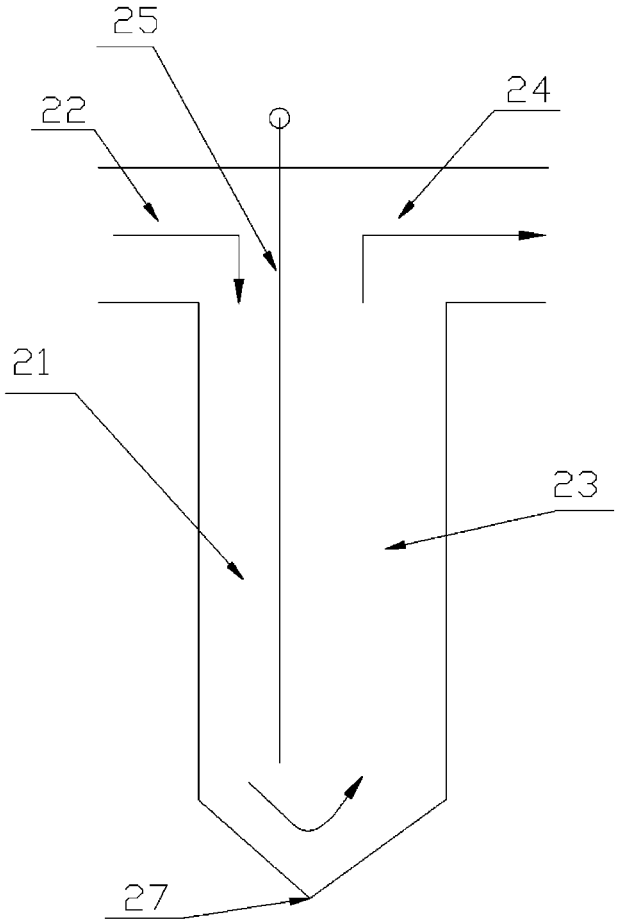
FIG. 20 shows a flow route diagram of flue gas flowing in the middle flue shown in FIG. 4.

The high-temperature flue gas flows through the hearth 10, the hearth outlet downward flue 21, the upward flue 23 and the tail downward flue 30 in turn, and then leaves the boiler body through the flue gas outlet 33. FIG. 20 shows a flow route diagram of flue gas flowing in the middle flue shown in FIG. 4; as shown in FIG. 20, the flue gas flows in an integrated U-shaped circulation channel in the hearth outlet downward flue 21 and the upward flue 23.

The above is only the preferred embodiment of the disclosure and not intended to limit the disclosure. For those skilled in the art, various modifications and changes can be made to the disclosure. Any modification, equivalent substitute and improvement made within the spirit and principle of the disclosure are deemed to be included within the protection scope of the disclosure.

The invention claimed is:

1. A pulverized coal boiler suitable for ultrahigh steam temperature, comprising:

a hearth including a lower end comprising a slag hole;

a tail downward flue including a lower end comprising a flue gas outlet;

wherein the pulverized coal boiler further comprises a middle flue arranged to permit flue gas communication between the hearth and the tail downward flue, and the middle flue comprises:

a hearth outlet downward flue and an upward flue, wherein a bottom of the hearth outlet downward flue is arranged in flue gas communication with a bottom of the upward flue, wherein an upper end of the hearth outlet downward flue is arranged in flue gas communication with an upper end of the hearth, and wherein an upper end of the upward flue is arranged in flue gas communication with an upper end of the tail downward flue, to form a U-shaped circulation channel;

wherein multi-stage convection heating surfaces are arranged inside the middle flue, the multi-stage convection heating surfaces comprise final-stage convection heating surfaces connected with a steam turbine, and the final-stage convection heating surfaces are arranged below other stages of the multi-stage convection heating surfaces.

2. The pulverized coal boiler suitable for ultrahigh steam temperature according to claim 1, wherein a lower end of the middle flue is arranged a distance of 10 to 30 meters from the ground.

3. The pulverized coal boiler suitable for ultrahigh steam temperature according to claim 1, wherein the hearth outlet downward flue and the upward flue are arranged as two separate and independent flues.

4. The pulverized coal boiler suitable for ultrahigh steam temperature according to claim 1, wherein the middle flue further comprises a vertical flue arranged between the hearth and the tail downward flue; an upper end of the vertical flue is arranged in flue gas communication with the upper end of the hearth and the upper end of the tail downward flue through a first horizontal flue and a second horizontal flue; and an interior of the vertical flue is provided with a first partition wall which extends downward from a top of the vertical flue to divide the vertical flue into the hearth outlet downward flue and the upward flue.

5. The pulverized coal boiler suitable for ultrahigh steam temperature according to claim 1, wherein each convection heating surface of the final-stage convection heating surfaces is arranged at a lower part of at least one of the hearth outlet downward flue and the upward flue; and each convection heating surface of the other stages of the multi-stage convection heating surfaces is arranged in at least one of the upward flue and the tail downward flue.

6. The pulverized coal boiler suitable for ultrahigh steam temperature according to claim 5, wherein the other stages of the multi-stage convection heating surfaces comprise convection heating surfaces in parallel arrangement within the upward flue; a second partition wall is arranged between the convection heating surfaces in parallel arrangement; and a flue gas baffle is arranged above the second partition wall.

7. The pulverized coal boiler suitable for ultrahigh steam temperature according to claim 1, wherein the other stages of the multi-stage convection heating surfaces comprise one or more of superheater, reheater, and economizer.

8. The pulverized coal boiler suitable for ultrahigh steam temperature according to claim 1, wherein an outside of the middle flue is provided with a wall enclosure heating surface or a guard plate.

9. The pulverized coal boiler suitable for ultrahigh steam temperature according to claim 1, wherein each of the lower end of the middle flue and the lower end of the tail downward flue includes an ash hole.

10. The pulverized coal boiler suitable for ultrahigh steam temperature according to claim 1, wherein an air preheater is arranged inside the tail downward flue.

11. The pulverized coal boiler suitable for ultrahigh steam temperature according to claim 10, wherein at least one of a denitration system and a convection heating surface is further arranged inside the tail downward flue.

12. The pulverized coal boiler suitable for ultrahigh steam temperature according to claim 1, wherein:

a periphery of the hearth comprises a water cooled wall; and a wall enclosure superheater is arranged above the water cooled wall;

a top portion each of the hearth, the middle flue, and the tail downward flue comprises a ceiling superheater;

an upper portion of the hearth comprises a platen radiant heating surface.

13. An ultra-supercritical thermal power generating unit comprising the pulverized coal boiler suitable for ultrahigh steam temperature according to claim 1 arranged to supply steam to a steam turbine.

14. A method of generating electric power utilizing the ultra-supercritical thermal power generating unit according to claim 13, the method comprising use of the pulverized coal boiler to supply steam to a steam turbine.

15. The method of generating electric power according to claim 14, wherein steam is supplied to the steam turbine at a temperature of at least 700° C.

* * * * *